US007059507B2

(12) United States Patent
Almeras et al.

(10) Patent No.: US 7,059,507 B2
(45) Date of Patent: Jun. 13, 2006

(54) APPARATUS FOR DRIVING FASTENERS, WITH SAFETY SHOE

(75) Inventors: Roland Almeras, Tournon (FR); Patrick Herelier, Saint Jean de Muzols (FR); Emmanuel Vallon, Portes les Valence (FR)

(73) Assignee: Societe de Prospection et d'Inventions Techniques SPIT, Bourg-les-Valence (FR)

( * ) Notice: Subject to any disclaimer, the term of this patent is extended or adjusted under 35 U.S.C. 154(b) by 0 days.

(21) Appl. No.: 10/885,780

(22) Filed: Jul. 8, 2004

(65) Prior Publication Data

US 2005/0017046 A1 Jan. 27, 2005

(30) Foreign Application Priority Data

Jul. 23, 2003 (FR) ..... 03 08999

(51) Int. Cl.
*B27F 7/13* (2006.01)

(52) U.S. Cl. ..... 227/8; 227/119; 227/120; 227/123; 227/125

(58) Field of Classification Search ..... 227/8, 227/120, 119, 123, 125
See application file for complete search history.

(56) References Cited

U.S. PATENT DOCUMENTS

| | | | | |
|---|---|---|---|---|
| 3,893,610 | A * | 7/1975 | Smith | 227/8 |
| 5,020,712 | A * | 6/1991 | Monacelli | 227/8 |
| 5,167,359 | A | 12/1992 | Frommelt | |
| 5,441,191 | A * | 8/1995 | Linden | 227/120 |
| 5,597,972 | A * | 1/1997 | Wachter | 89/1.14 |
| 6,056,181 | A * | 5/2000 | Chuang | 227/8 |
| 6,267,284 | B1 * | 7/2001 | Clark | 227/8 |
| 6,708,860 | B1 * | 3/2004 | Thieleke | 227/8 |
| 6,783,043 | B1 * | 8/2004 | Jakob et al. | 227/8 |

FOREIGN PATENT DOCUMENTS

EP 0 987 086 A2 3/2000

* cited by examiner

*Primary Examiner*—Scott A. Smith
*Assistant Examiner*—Gloria R. Weeks
(74) *Attorney, Agent, or Firm*—Lowe Hauptman & Berner, LLP

(57) ABSTRACT

Apparatus for driving fasteners includes a barrel, a fastener guide which retreats as the apparatus is pressed against a substrate, a feed magazine, receiving a loader of fasteners, and a safety element configured to allow a fastener to be driven only after the fastener guide has retreated. There is a safety shoe configured to, when there is no fastener in the barrel, be moved into a safe position and prevent the retreat of the fastener guide, and including a tell-tale of the safe position of the safety shoe.

9 Claims, 2 Drawing Sheets

APPARATUS FOR DRIVING FASTENERS, WITH SAFETY SHOE

RELATED APPLICATIONS

The present application is based on, and claims priority from, French Application Number 03 08999, filed Jul. 23, 2003, the disclosure of which is hereby incorporated by reference herein in its entirety.

FIELD OF THE INVENTION

The present invention relates to an apparatus for driving fasteners of the nail or staple type—in which case it is a nail gun or a staple gun—comprising a barrel with, at the front, a fastener guide designed to retreat as the apparatus is pressed against something, a feed magazine, intended to receive a loader of fasteners and to introduce one fastener into the barrel, and pressing-against-something safety means designed to allow a fastener to be driven only after the fastener guide has retreated and comprising a safety shoe designed to, when there is no fastener in the barrel, be moved into a safe position and prevent the retreat of the fastener guide.

BACKGROUND OF THE INVENTION

The apparatus concerned here is, in theory, one known as an indirectly fired anchor gun in which a flyweight, intended to drive a tack, an insert, or any other similar fastener, is propelled forwards under the action of the combustion of the charge of powder or the explosion of a flammable mixture of gases.

The fastener guide is more generally known as tack guide. This guide is often separate from the barrel and mounted in front of the barrel. Sometimes, the front part of the barrel acts as a tack guide, and, in this case, it is the entire barrel which is designed to be moved backwards as the apparatus is pressed against something, in the context of bearing safety.

As far as the safety shoe is concerned, when there is no fastener in the barrel, a spring pushes it towards the axis of the barrel into the retreat path of the tack guide, thus preventing the latter from retreating. This safety shoe has been designed to avoid the apparatus being operated empty, as this would be detrimental, firstly because practically all the firing. energy would be absorbed by the apparatus itself, but also because of the risk that the flyweight might penetrate the support material.

As for the loader, it has a push-rod for introducing fasteners into the barrel of the apparatus one by one, with a tell-tale of the advance of the push-rod.

However, when the push-rod of the loader has reached its extreme position, furthest forward in the loader, that is to say has reached the last fastener, the push-rod advance tell-tale is unable to determine whether or not there is still a fastener in the barrel, that is to say whether or not this fastener has already been used.

SUMMARY OF THE INVENTION

The invention in this application aims to alleviate this disadvantage and to offer the user of the apparatus the benefit of good information, allowing him not to have to wonder whether the barrel of his apparatus is empty or whether his apparatus is working incorrectly.

Thus, the present application relates to an apparatus of the type specified hereinabove, characterized in that it comprises a tell-tale of the safe position of the safety shoe.

In a preferred embodiment of the apparatus of the invention, the tell-tale comprises a peg secured to the shoe and mounted to slide, from an operating position to a safe position, in a well opening into an opening in the surface of the casing of the apparatus.

Advantageously the peg has a length such that in the operating position its free end is visible in the opening of the well and hidden in the safe position.

As a preference, the shoe and the tell-tale are formed as a single piece.

BRIEF DESCRIPTION OF THE DRAWING

The invention will be better understood in light of the following description of the apparatus for driving fasteners according to the invention, with reference to the attached drawing in which.

DETAILED DESCRIPTION OF THE INVENTION

Figure 2:
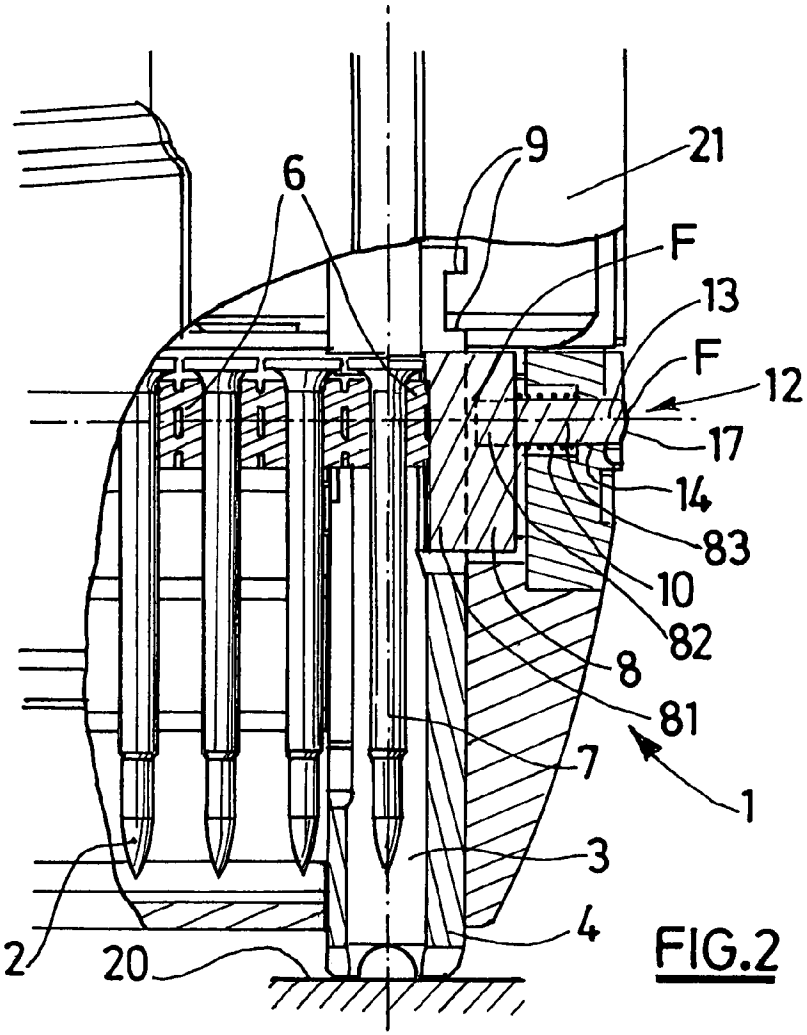
FIG. 2 depicts a view, in the same section, of the apparatus of the invention when it is loaded and in a firing position.
Figure 1:
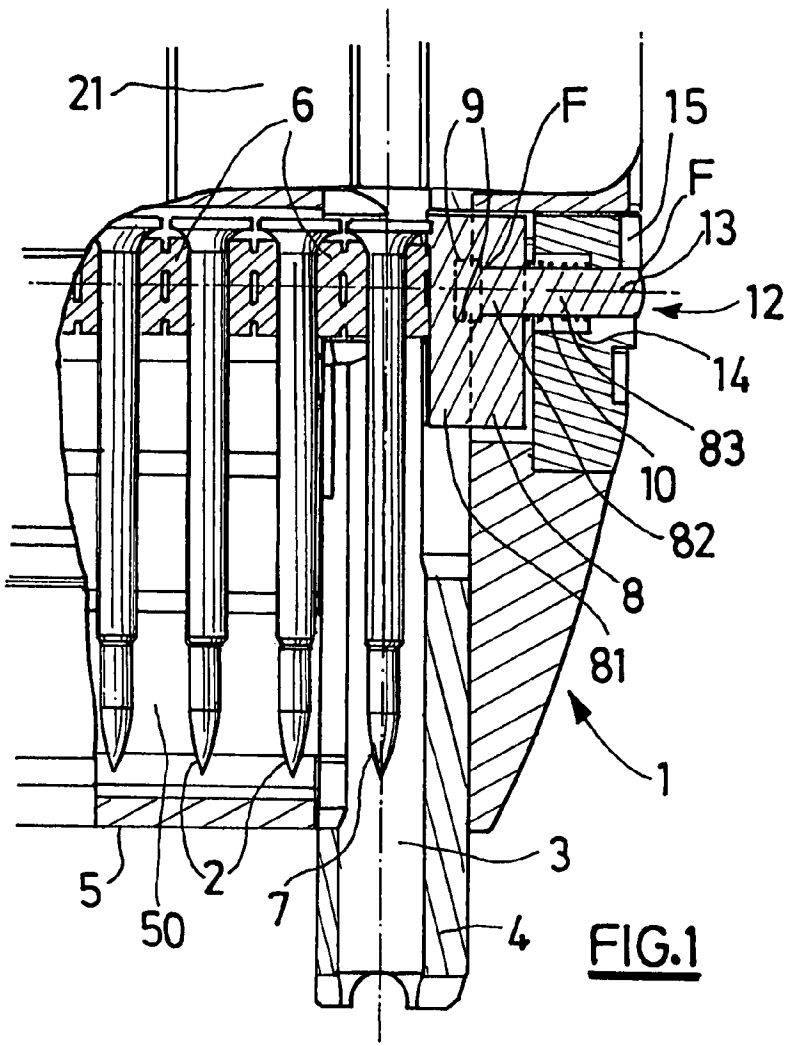
FIG. 1 depicts a view in section, along the axis of the barrel, of the apparatus of the invention when it is loaded and in a rest position.

With reference to FIGS. 1 and 2, the apparatus 1 for driving fasteners, in this instance an anchor gun, comprises a fastener guide 4, formed by the front part of the barrel 3 of the gun 1, and a feed magazine 5 in which there is housed a loader 50 of fasteners, in this instance tacks 2, 7, joined together in a string by guide pegs 6.

In the loader 50, the tacks 2, 7 are kept aligned and, by virtue of a push-rod 11, pushed one by one into the barrel, in pace with the firings.

The tack guide 4 can slide towards the rear 21 of the gun when it is pressed against a support material 20 into which a tack is to be driven.

According to the safety feature known as the pressing-against-something safety feature, the drive, or firing, of the tack 7 introduced into the barrel can be performed only if the tack guide is pressed against the material 20, as depicted in FIG. 2. For that, pressing-against-something safety means perfectly known to those skilled in the art, and therefore not depicted, allow firing to be performed only in such an instance.

Figure 3:
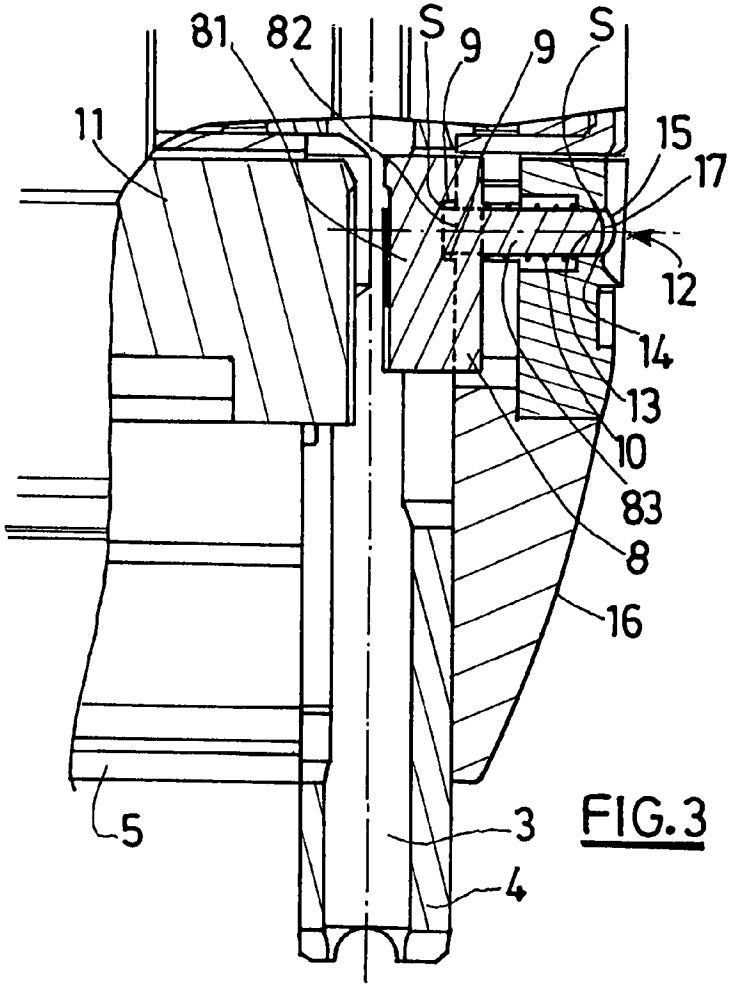
FIG. 3 depicts a view, in the same section, of the apparatus of the invention, in a rest position, when the loader is empty.

According to another precautionary measure aimed at ensuring correct use of the gun, a safety shoe 8 is provided, this being designed to prevent the tack guide 4 from retreating if the barrel 3 is empty, as depicted in FIG. 3.

The shoe 8 essentially consists of a roughly parallelepipedal pad 81 comprising a finger 82, also parallelepipedal, designed to fit into a slot 9 in the tack guide when the pad 81 is in the barrel, and to disengage therefrom when the said pad is pushed back out of the barrel, and comprising a cylindrical piston 83 designed to slide in a well 14 formed in the casing of the gun.

The shoe 8 is pushed transversely with respect to the axis of the barrel by a helical spring 10 surrounding the piston 83, and is guided in this direction by the said piston. When the action of the spring 10 on the pad 81 of the shoe 8 is not compensated for by the push-rod 11 of the loader 50, there being no tack 7 in the barrel, the finger 82 enters the slot 9 of the tack guide 4, thus preventing it from being brought into the position of bearing against something and thus preventing any subsequent firing. If a tack 7 is present, the finger 82 disengages from the slot 9, the tack guide is released and firing may be performed.

An indicator indicating the advance of the push-rod 11 (not depicted) which indicates it position in the loader 50, and particularly indicates whether it is in abutment at the head of the loader, as in FIG. 3, is provided, but this indicator is unable to indicate whether or not the last tack in the loader has been fired, because it does not change position after this firing. The user can therefore remain uncertain as to whether or not there is a still a tack in the barrel.

Provision is made for the gun also to comprise a tell-tale 12 indicating the position of the safety shoe 8. For that, the shoe 8 comprises a peg 13 to which it is secured (or with which it is integral) sliding, with the piston 83, in the well 14 which opens into an opening 15 in the surface 16 of the casing of the gun.

In the example, the peg 13 is simply a continuation of the piston 83.

When a tack 7 is present in the barrel (FIGS. 1 and 2), the shoe 8 is pushed back by the tack 7 under the action of the push-rod 11 of the loader 50, the peg 13 is in the operating position (F) and its free end 17 is visible through the opening 15.

Figure 4:
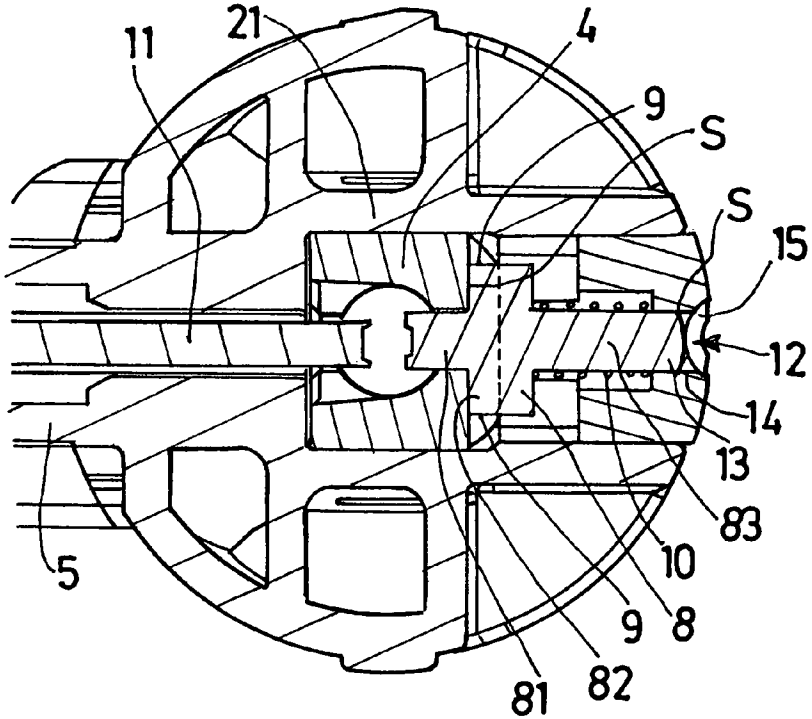
FIG. 4 depicts a view in section, on the plane orthogonal to the axis of the barrel and passing through the tell-tale, of the apparatus of the invention when the loader is empty.

When, after the last firing, there are no longer any tacks 7 in the barrel (FIGS. 3 and 4), the shoe 8 is pushed back by the spring 10, the peg 13 is in the safe position (S) and its free end 17 is hidden, thus dispelling the uncertainty in the mind of the user of the gun.

The invention claimed is:

1. An apparatus for driving fasteners, said apparatus comprising:

a barrel;

a fastener guide moveably mounted at a front end of said barrel, said fastener guide being retractable axially rearwardly relative to said barrel to a rear position to whereby permit firing of said apparatus;

a safety locking element moveable between a safe position, when there is no fastener in a firing position in the fastener guide and said safety locking element prevents axial rearward movement of said fastener guide to the rear position thereby impending firing of said apparatus, and an operating position, when said safety locking element allows axial rearward movement of said fastener guide to the rear position, said safety locking element being releasable from the safe position in response to a presence of a fastener in the firing position in said fastener guide; and a safety indicator carried by said safety locking element, said safety indicator being visible from an outside of said apparatus through an aperture on a wall of said barrel when said safety locking element is in the operating position, said safety indicator being retractable radially inwardly relative to said barrel in response to said safety locking element moving from the operating position to the safe position wherein said safety locking element comprises:

an upper portion having an upper end defining said safety indicator;

a lower portion having a lower end engageable with the fastener in the firing position in said fastener guide; and a middle portion connecting said upper and lower portion and being engageable with said fastener guide when said safety locking element is in the safe position;

said apparatus further comprising a spring biasing said safety locking element in a direction from the operating position towards the safe position.

2. The apparatus of claim 1, wherein said spring is a coil spring and said upper portion is received in an internal space of said coil spring.

3. The apparatus of claim 1, further comprising a hole extending through said wall of said barrel and opening to the outside via said aperture;

said hole having a portion with a reduced inner diameter that defines a first flange against which an upper end of said spring rests.

4. The apparatus of claim 3, wherein when said safety locking element is in the operating position, said upper end of said upper portion projects upwardly beyond the aperture of said hole, and, when there is no fastener in the firing position of said fastener guide and said safety locking element is in the safe position, said upper end of said upper portion is completely retracted inside said hole.

5. The apparatus of claim 3, wherein said middle portion has a lateral dimension greater than that of said upper portion, and said middle portion defines on an upper face thereof a second flange against which a lower end of said spring rests.

6. The apparatus of claim 5, wherein the lateral dimension of said middle portion is greater than that of said lower portion, and said middle portion defines on a lower face thereof a third flange engageable with a bottom of a slot formed on a wall of said fastener guide.

7. The apparatus of claim 6, wherein an engagement of said third flange and said bottom of the slot formed on the wall of said fastener guide defines the safe position of said safety locking element.

8. The apparatus of claim 7, wherein said slot further opens into an internal space of said fastener guide via a bore extending through said wall of said fastener guide, said bore being sized to allow said lower portion, but not said middle portion, of said safety locking element to pass therethrough.

9. The apparatus of claim 7, wherein said middle portion further comprises a front face, other than said third flange, which is engageable with a side wall, other than said bottom, of said slot when the safety locking element is in the safe position to prevent axial rearward movement of said fastener guide to the rear position.

* * * * *